United States Patent [19]

Mills et al.

[11] Patent Number: 4,676,914

[45] Date of Patent: Jun. 30, 1987

[54] MICROPROCESSOR BASED PUMP CONTROLLER FOR BACKWASHABLE FILTER

[75] Inventors: Donald E. Mills; Rodger J. Grys, Norwalk, both of Ohio

[73] Assignee: North Coast Systems, Inc., Norwalk, Ohio

[21] Appl. No.: 712,897

[22] Filed: Mar. 18, 1985

Related U.S. Application Data

[63] Continuation-in-part of Ser. No. 476,813, Mar. 18, 1983, Pat. No. 4,505,643.

[51] Int. Cl.[4] ..... B01D 35/00; B01D 41/00

[52] U.S. Cl. ..... 210/741; 210/108; 210/138; 210/169; 55/96; 55/283; 417/12

[58] Field of Search ..... 210/108, 138, 741, 89, 210/90, 416.2, 169, 134, 141; 417/12, 33, 44; 364/500, 502; 55/96, 283

[56] References Cited

U.S. PATENT DOCUMENTS

| | | | |
|---|---|---|---|
| 3,581,895 | 6/1971 | Howard et al. | 210/108 |
| 3,616,915 | 11/1971 | Whitlock | 210/108 |
| 3,630,363 | 12/1971 | Nash et al. | 210/108 |
| 3,670,893 | 6/1972 | Seid | 210/138 |
| 3,957,395 | 5/1976 | Ensign | 417/12 |
| 3,963,375 | 6/1976 | Curtis | 417/12 |
| 4,180,374 | 12/1979 | Bristow | 417/12 |
| 4,273,513 | 6/1981 | Salina | 417/12 |
| 4,329,120 | 5/1982 | Walters | 417/12 |
| 4,394,262 | 7/1983 | Bukowski et al. | 210/108 |
| 4,482,461 | 11/1984 | Hindman et al. | 210/741 |
| 4,487,689 | 12/1984 | Galaj | 210/138 |
| 4,505,643 | 3/1985 | Millis et al. | 210/416.2 |

*Primary Examiner*—Richard V. Fisher
*Assistant Examiner*—Linda S. Evans
*Attorney, Agent, or Firm*—Fay, Sharpe, Beall, Fagan, Minnich & McKee

[57] ABSTRACT

A pump (B) pumps water from a swimming pool (A) to a forward/reverse direction control valve (D). The control valve (D) has a first or forward flow state in which it channels water into an inlet (20) of a filter (C) and from a filter outlet (24) back to the swimming pool and a second state in which it channels the water into the fluid outlet (24) and from the fluid inlet to a drain (28). A microprocessor based electronic control circuit (E) selectively actuates the pump at preselected intervals for preselected durations such that the water from the swimming pool is intermittently filtered. The control circuit further monitors the fluid pressure with a low pressure limit switch (46). In response to the pumped fluid pressure failing to achieve a low limit within a preselected duration, the control circuit terminates operation of the pump. Further, the control circuit monitors the water pressure with a high pressure limit switch (48). In response to the monitored pressure exceeding the high limit, the control circuit causes the forward/reverse valve (D) to assume its second state and backwash the filter automatically. The microprocessor also calculates the volume of fluid discharged through a drain, which is automatically replaced with fresh fluid.

6 Claims, 5 Drawing Figures

MICROPROCESSOR BASED PUMP CONTROLLER FOR BACKWASHABLE FILTER

BACKGROUND OF THE INVENTION

This application is a continuation-in-part of earlier filed application Ser. No. 467,813, filed Mar. 18, 1983, now U.S. Pat. No. 4,505,643.

The present invention relates to electrical apparatus controllers for controlling fluid pumps or the like. It finds particular application in the cyclic control of fluid circulating pumps, such as the pumps for circulating water through swimming pool filter systems. It is to be appreciated, however, that the present invention is also applicable to controlling circulating pumps of other types, including water heating and cooling systems, industrial fluid circulating or mixing systems, and the like.

Heretofore, various control systems have been developed for periodically actuating electrical pumps and other apparatus. Some prior art control systems further monitored the controlled electrical apparatus for malfunctions, such as excessive pump pressure. Upon sensing excessive pump pressure, such prior art control systems terminated operation of the fluid pump, actuated an alarm, or the like.

Low pressure, however, can be just as deleterious or more than high pressure. Operating a pump at sub-minimal pressure may cause the pump motor to overheat or burn out.

In a periodically operated pump, of course, the fluid pressure commonly falls below the minimal operating pressure between actuations. Upon initial actuation, some lead time is commonly required to prime the pump and to build the fluid pressure up to normal. In such a periodically actuated pump, a low pressure cut off switch could shut off before the pressure builds to normal, hence rendering the system inoperative.

The present invention provides a new and improved controller which overcomes the above-referenced problems and others, yet protects automatically operated pumps without human interaction.

SUMMARY OF THE INVENTION

In accordance with one aspect of the present invention, a fluid circulation control system is provided. A flow direction control means selectively controls the circulation of fluid through a fluid appliance between a first flow direction and a second flow direction. A fluid pumping means selectively pumps the fluid under pressure to the flow direction control means for circulation through the fluid appliance. A pressure sensing means senses the fluid pressure adjacent the fluid appliance. A microprocessor monitors the sensed fluid pressure and selectively controls the flow direction control means and the fluid pumping means in accordance therewith.

In accordance with a more limited aspect of the invention, the microprocessor includes a time delay means for providing a first preselected time delay for the pumped fluid to build to a preselected low pressure limit. A low pressure determing means determines whether the sensed fluid pressure exceeds the preselected low pressure limit. In response to the sensed pressure failing to achieve the low limit pressure within the preselected duration, the microprocessor terminates operation of the fluid pumping means.

In accordance with another aspect of the present invention, the microprocessor includes a high pressure determining means for determining whether the sensed fluid pressure exceeds a preselected high limit pressure. In response to sensing the high limit pressure, a flow direction control actuator selectively causes the flow direction control means to reverse the direction of fluid flow through the fluid appliance. A reverse direction timer causes the fluid pumping means to be actuated to pump fluid through the fluid appliance in the reverse direction for a selected duration. In this manner, in response to sensing the high limit pressure, the fluid appliance is backwashed for the preselected duration.

In accordance with another aspect of the present invention, a method is provided for controlling the circulation of fluid through a fluid appliance. Fluid is intermittently pumped through the fluid appliance as the fluid pressure is monitored. Under the control of a microprocessor, a determination is made whether the sensed fluid pressure exceeds a preselected limit pressure. If the sensed pressure fails to exceed the preselected low limit pressure within a preselected duration, pumping of the fluid is terminated. In response to the microprocessor determining that the sensed pressure exceeds a preselected high limit pressure, the direction of fluid flow through the fluid appliance is reversed.

One advantage of the present invention is the protection of the circulating pump from low pumping pressure damage.

Another advantage of the present invention is the automatic initiation of a backwash or reverse flow routine to protect the pump from operating at an injuriously high pressure.

Yet another advantage of the present invention is that it protects fluid swimming pool filtration systems and other fluid circulation systems which are operated automatically and without immediate human supervision from damaging malfunctions.

Still further advantages of the present invention will become apparent to those of ordinary skill in the art upon reading and understanding the following detailed description.

BRIEF DESCRIPTION OF THE DRAWINGS

The invention may take form in various parts and arrangements of parts or in various steps and arrangements of steps. The drawings are only for purposes of illustrating a preferred embodiment of the invention and are not to be construed as limiting it; wherein the drawings show.

DETAILED DESCRIPTION OF THE PREFERRED EMBODIMENT

Figure 1:
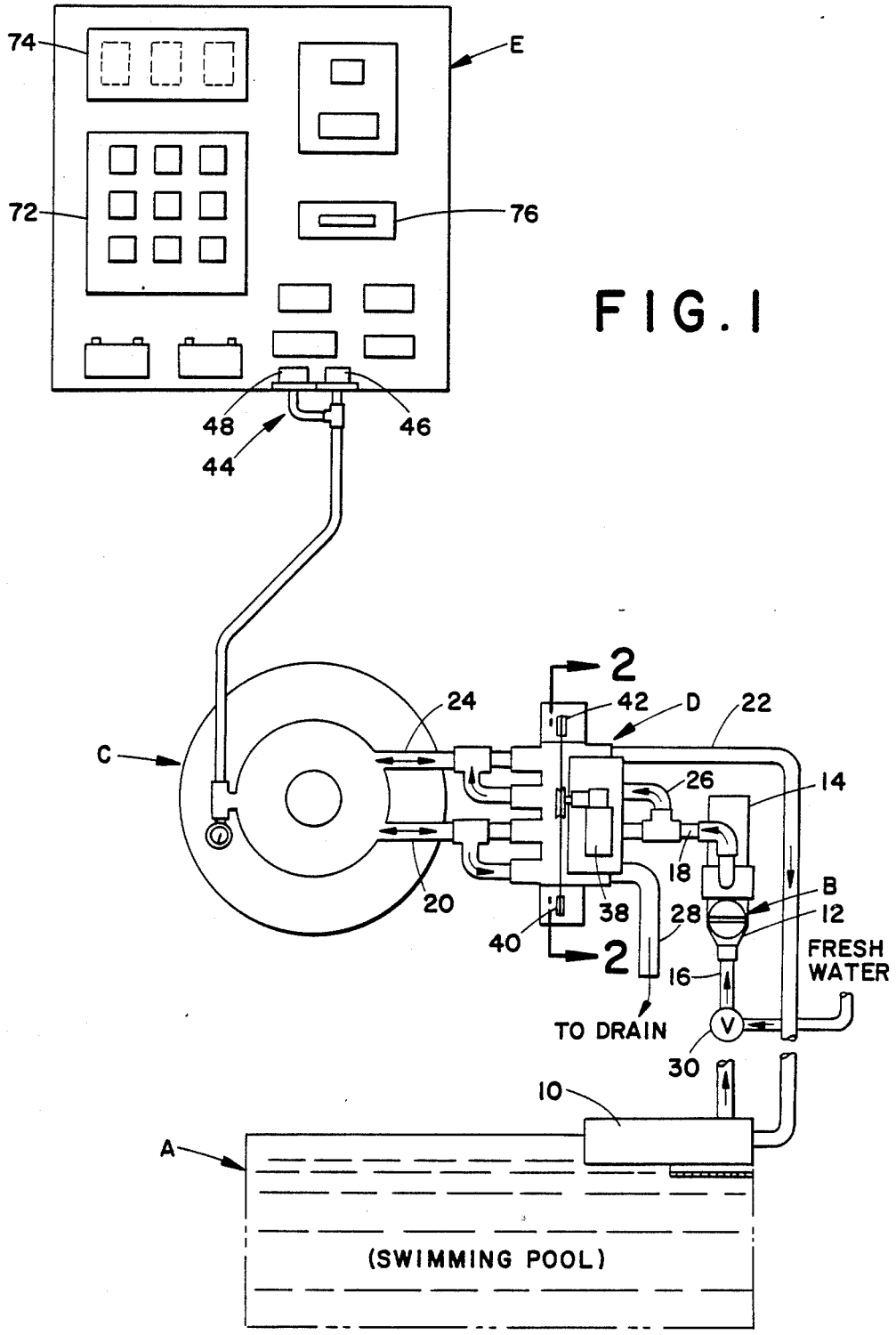
FIG. 1 is a diagrammatic illustration of a water circulation system in accordance with the present invention.

With reference to FIG. 1, a reservoir A, such as a swimming pool, provides a supply of fluid to be circulated. A fluid pumping means B pumps the fluid from the reservoir A to a fluid appliance C, such as a filter. A flow direction control means D directs the fluid through the fluid appliance C in either a first or filtering direction or a second or backwash direction. A microprocessor based control E monitors selected system parameters, such as the pessure of the circulated fluid, and controls operation of the fluid pumping means B and the flow direction control means D. Preferably, the control circuit intermittently operates the fluid pumping means with a preselected duration and periodicity. In response to a failure to maintain a preselected low limit pressure after a preselected priming duration, actuation of the fluid pumping means is terminated. In response to the sensed pressure exceeding a preselected high limit pressure, the flow direction control means is caused to reverse the direction of fluid flow and a backwash cycle is initiated.

The swimming pool A includes a skimmer 10 disposed generally at the pool water level. The fluid circulating means B includes a fluid pump 12 driven by a pump motor 14. A supply or inlet line 16 supplies fluid from the skimmer 10 to the pump 12. An untreated fluid line 18 supplies the fluid from the pump 12 to an inlet 20 of the appliance or filter C. A fluid return line 22 returns the treated or filtered water from a filter outlet 24 to the swimming pool A. A branch line 26 selectively directs fluid from the pump to the filter outlet.

Figure 2:
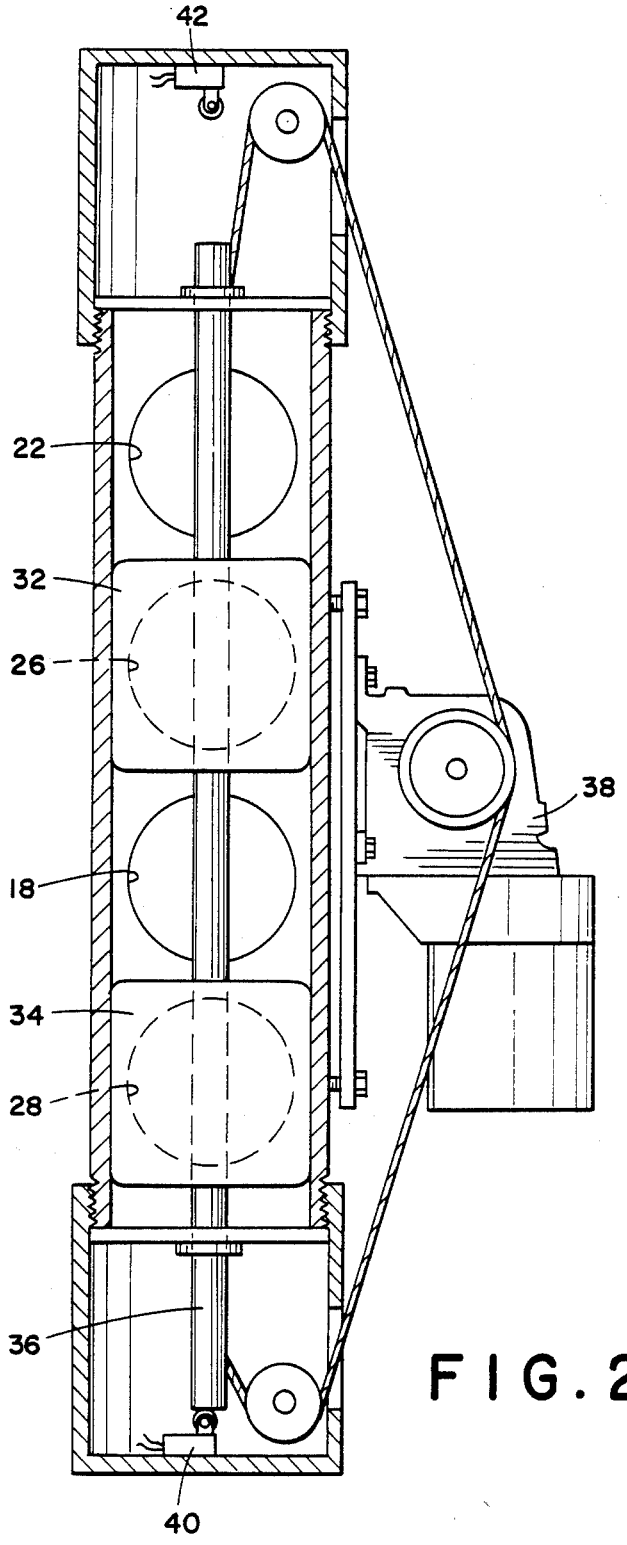
FIG. 2 is a detailed cross section of a flow direction reversing valve of FIG. 1.

With continuing reference to FIG. 1 and secondary reference to FIG. 2, the flow direction controlling means D has two states. In a first or filtering state, it channels the fluid from the pump 12 to the filter inlet 20 and from the filter outlet 24 to the fluid return line 22. In a second or backwash state, it channels fluid from the pump 12 to the fluid outlet 24 and from the filter inlet 20 to a drain line 28. A fresh water supply valve 30 selectively supplies fresh water, e.g. to replace the water drained during the backwash.

With primary reference to FIG. 2, the flow direction control means D includes a pair of baffles 32, 34 which are mounted to a control shaft 36. In the first or filtering state (illustrated), the first baffle 32 blocks branch line 26 to prevent fluid from the pump 12 from reaching the filter outlet 24. The second baffle 34 blocks the fluid at the filter inlet from passing to the drain 28. In the second or backwash state, the first baffle 32 blocks the flow of fluid to the return line 22 and the second baffle 34 blocks the flow of fluid from the pump through the untreated fluid line 18 to the filter inlet 20. The branch line 26 is connected with the fluid outlet 24 and the drain line 28 is connected with the filter inlet 20. An electrically operated controller 38 selectively moves the baffles 32, 34 between the first and second states. A normally closed first or filter limit switch 40 is held open when the flow control means is in the first or filtering state. A normally open second or backwash limit switch 42 is closed when the baffles are in the second or backwash state.

Referring again to FIG. 1, a pressure sensing means 44 senses the pressure of the fluid adjacent the filter, particularly adjacent the filter inlet 20. In the peferred embodiment, the pressure sensing means includes a low pressure sensing switch 46 which closes when the fluid pressure reaches a preselected low limit, e.g. 5 psi. A high pressure sensing switch 48 closes when the monitored pressure reaches a preselected high limit, e.g. 15 psi.

Figure 3:
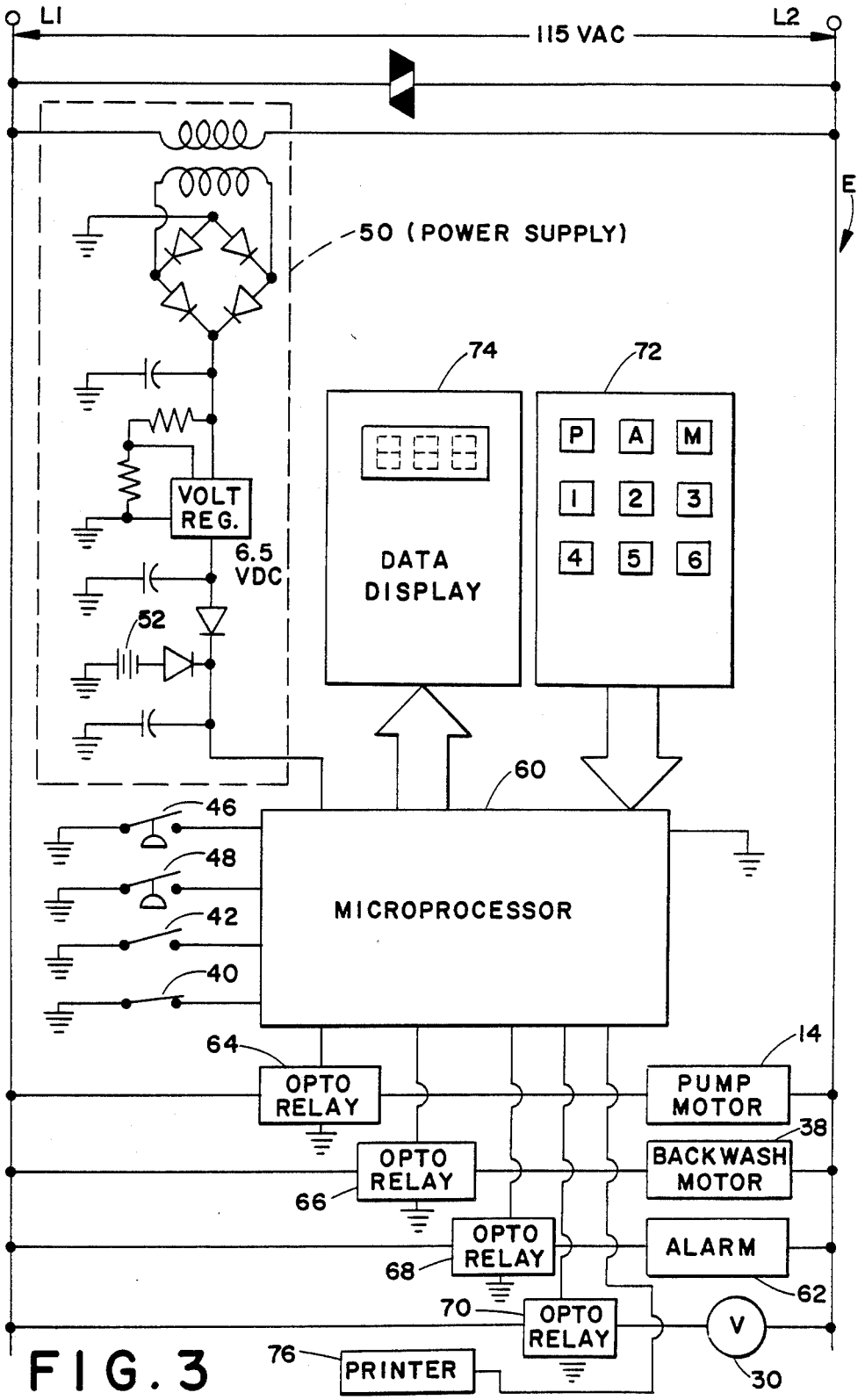
FIG. 3 is a circuit diagram for a microprocessor based control circuit in accordance with the present invention; and, FIGS. 4A and 4B are a two-part diagrammatic illustration of a programming flow chart for programming the microprocessor of FIG. 3 in accordance with the present invention.

With reference to FIG. 3, the control E includes a power supply 50. In the preferred embodiment, the power supply 50 receives electrical power from 115 VAC electric power source. The power supply drops the voltage level, rectifies it and provides a regulated voltage, in the preferred embodiment 6.5 VDC. A battery backup 52, preferably lithium batteries, provides an emergency power supply to maintain the program and memory of a microprocessor 60 in the event of a power failure.

The microprocessor 60 monitors the output of the pressure sensing means 44 including the low pressure sensing switch 46 and the high pressure sensing switch 48. Additionally, the microprocessor monitors the flow direction limit switches 40, 42 of the flow direction control means D. The microprocessor is pre-programmed to cause the pump motor 14 to cycle on and off at selected times or intervals. Further, the microprocessor program causes the flow direction motor 38 and warning lights or other alarms 62 and the pump motor 14 to be actuated and de-actuated in response to the monitored pressure and output of the flow direction limit switches 40, 42. After the backwash, the microprocessor calculates the volume of water discharged during the backwash and opens the fresh water valve 30 for a duration appropriate to replace the discharged water. More particularly, the microprocessor controls power transfer means, such as opto relays 64, 66, 68, and 70. The opto relays are selectively opened and closed to supply power to the pump motor 14, the fresh water valve 30, the flow direction control motor 38, and the alarms 62.

A microprocessor input means 72 allows the operator to select among a plurality of operating modes, such as automatic and manual, to input data to adjust the pumping intervals or durations, or input other data to adjust or change the computer program of the microprocessor. A data display terminal 74 selectively displays various information about the operation of the control system. For example, the data display termianl 74 indicates whether it is running in an automatic or manual mode, whether the system is backwashing, may selectively be called upon to indicate pumping durations or intervals, or display other system data. A printer 76 may be selectively called upon to provide a permanent record of various displayed information, such as a history of power failures and durations, filtering times and durations, backwash times and durations, and the like.

Figure 4A:
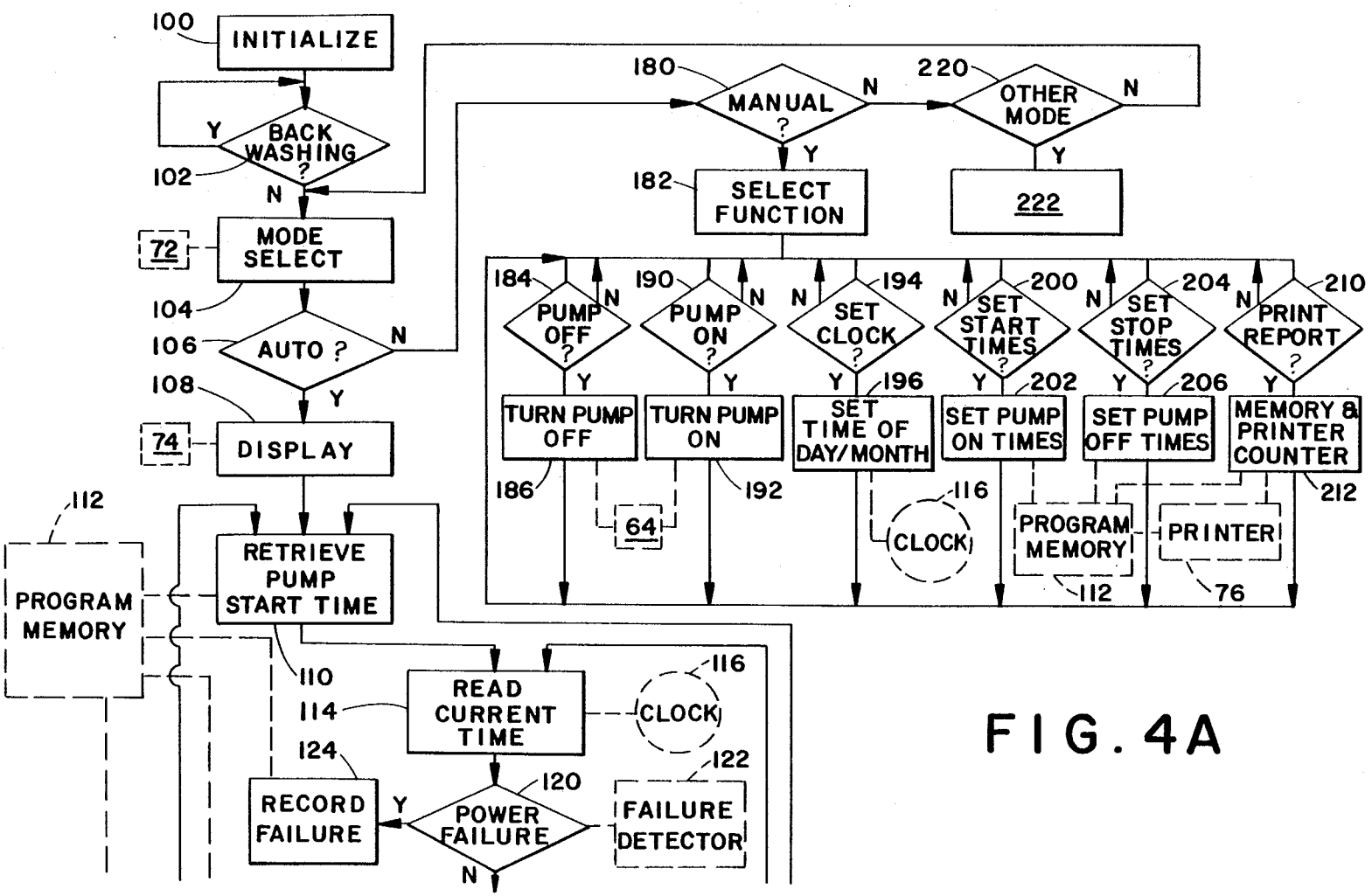
Figure 4B:
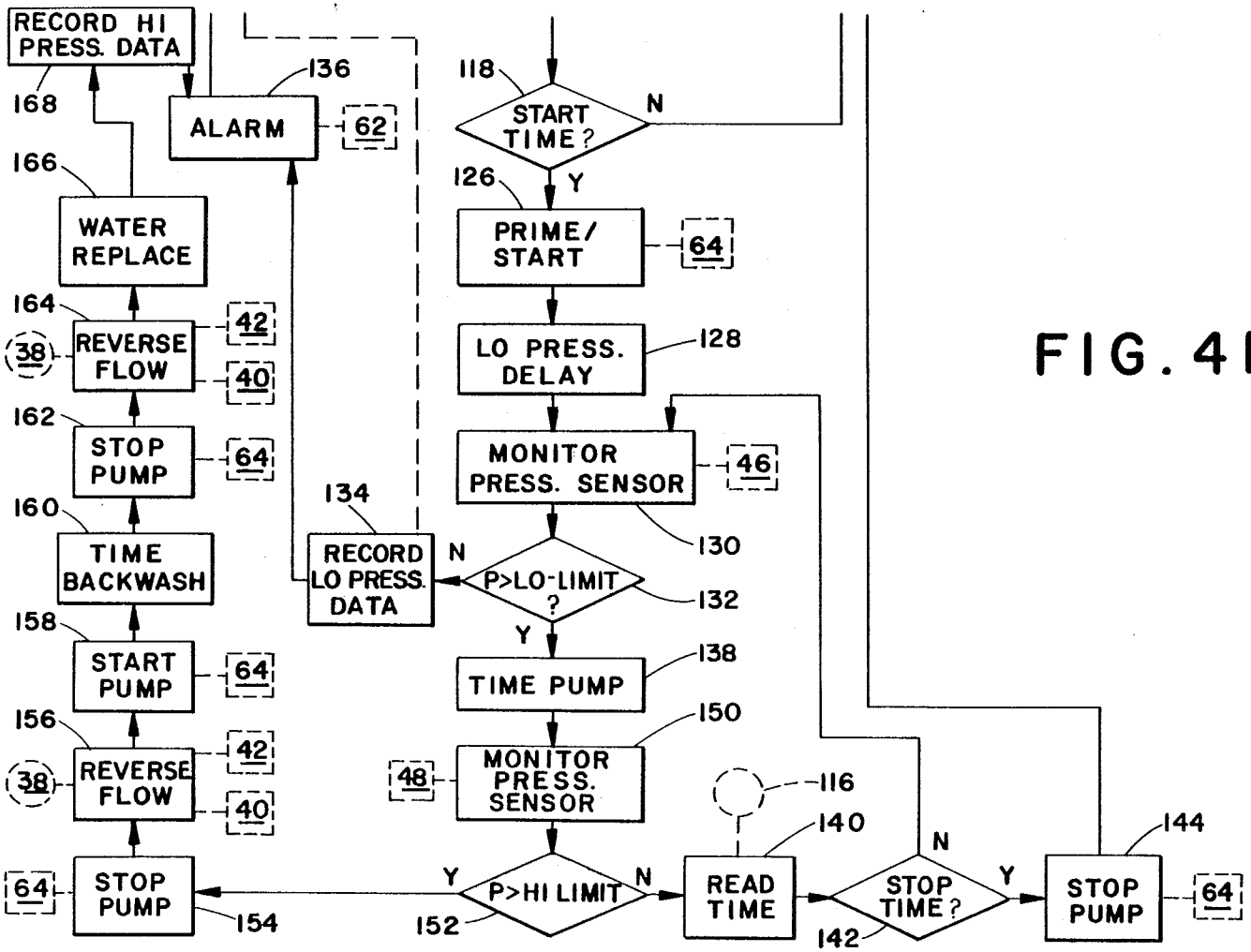

With reference to FIGS. 4A and 4B, the computer program includes an initializing means or step 100 for initializing the microprocessor 60. A backwash sensing means or step 102 senses whether limit switch 42 is closed indicating that the system is backwashing. If the system is backwashing, the program cycles or delays until the backwash is done. Optionally, a backwash reporting step or means may be provided causing the display 74 to indicate that a backwash is in progress. A mode select means or step 104 reads the operating mode selected by the operator on control panel 72. A comparing means or step 106 determines whether the automatic operating mode was selected. If the automatic mode was selected, a display control step or means 108 causes the data display 74 to display an indication that the system is in the automatic mode.

A retrieving means or step 110 retrieves the next pump start time from a program memory 112. A current time means or step 114 reads the current time from a clock 116. A pump start time determining means 118 compares the next pump start time with the current time. The program cycles through the time reading and comparing steps until the selected pump start time and the current time match.

A power failure determining step or means 120 determines whether a power failure sensor 122 has sensed a failure of the AC power to the power supply 50. In response to a sensed power failure, a power failure recording step or means 124 records the time and duration of the power failure in an appropriate memory location of the program memory 112.

When the start time determining means or step 118 determines that its time to commence a filtering or fluid treatment operation, a pump prime and start means or step 126 causes opto relay 64 to close, supplying power to the pump motor 14. A timing means or step 128 times a preselected low pressure delay which is selected to provide adequate time for the pump 12 to bring the pumped fluid up to the low pressure limit. A pressure reading step or means 130 monitors the pressure sensing means, particularly the low pressure limit switch 46. A low pressure limit determining means 132 determines whether the fluid pressure exceeds the low limit. If the fluid pressure fails to exceed the low pressure limit, a low pressure recording step or means 134 causes data concerning the low pressure failure to be recorded in the program memory 112. The data may include the time of the low pressure failure, the maximum pressure obtained, or the like. Further, a malfunction alarm triggering step or means 136 triggers the alarms 62.

A pump timing means or step 138 times the operation of the pump. In the preferred embodiment, the pump timing means retrieves a selected run or filtering time from the program memory 112 and a current time reading means or step 140 reads the current time. A comparing means or step 142 compares the current time with the retrieved run time. If the run time has not elapsed, the program returns to the pressure reading step 130 to continue monitoring the pressure as the pump is running. If the selected run time has expired, a stopping means or step 144 opens the opto relay 64 to stop the pump 12.

While the pump is running, a pressure reading means or step 150 monitors the fluid pressure as read from the pressure sensing means 44, particularly the high pressure limit switch 48. A comparing means or step 152 determines whether or not the fluid pressure exceeds the preselected high limit, i.e. if the high pressure switch is closed. If the pressure is below the high limit, the program continues to time the operating duration of the pump. If the pressure exceeds the high pressure limit, a backwashing routine is commenced.

Specifically, a stop means or step 154 stops the operation of the pump 14. A flow direction means or step 156 actuates the flow control means motor 38 to reverse the flow through the filter. After the flow direction has been reversed, as indicated by the limit switch 42 closing, the flow direction motor 38 is stopped and a pump starting step or means 158 starts the pump motor 14. A backwash timing means or step 160 times the backwash duration. Preferably, the backwash timing means or step 160 retrieves a preselected backwash time from the program memory 112. When the backwash is completed, a pump stopping means or step 162 stops the pump motor. A second flow reversing step or means 164 returns the flow direction controller D to its first or filtering state.

After the backwash has been completed, a water replacement step or means 166 opens the fresh water valve 30 to replace the water lost during the backwash. First, the volume of water discharged during the backwash is calculated from the duration of the backwash, the pumping pressure of pump 12, and the cross section of the drain line 28 and other piping. Second, the duration required to replenish the discharged volume is calculated based on the cross section of the fresh water line and the fresh water pressure, e.g. the pressure of pump 12 or the city water pressure. Because the cross section of drain line 28, pumping rate of pump 12, the cross section of the fresh water line, and the fresh water pressure remain constant, a look-up table may be provided to convert backwash time directly to fresh water refill time.

A high pressure data recording means or step 168 causes selected backwash or high pressure failure data to be recorded in the program memory 112, such as the backwash time, the monitored high pressure level, and the like. The alarm means or step 136 again provides an appropriate indication that a backwash has taken place. Thereafter, the program returns to pump start time retrieving step or means 110 to await the next pumping cycle.

If the mode determing step or means 106 determines that the automatic mode was not selected, a manual mode determing means or step 180 determines whether the manual mode was selected. If the manual mode was selected, a selected function step or means 182 determines which function has been manually initiated. A pump off step or means 184 determines whether the operator has input the command to stop the pump. If so, a pump control step or means 186 causes the opto relay 64 to open.

A pump on step or means 190 determines whether an operator has selected the command to turn the pump on. If so, a pump controlling means or step 192 causes the opto relay 64 to be closed providing power to the pump. A clock set determining means or step 194 determines whether or not the operator is resetting the clock 116. If the clock is to be reset, a time of day/month means or step 196 and resets the clock 116 accordingly.

A start time setting means or step 200 determines whether the operator has commanded that the pump start times be reset. If so, a memory control means or step 202 causes the pump start times in program memory 112 to be reset. A pump stop time resetting means or step 204 determines whether the operator has commanded that the filter duration or pump stop times be reset. If so, a memory control means or step 206 changes the filter duration or pump stop times recorded in the program memory 112.

A report means or step 210 determines whether the operator has called for a report to be printed. If the operator has called for a report to be generated, a memory and printer control means or step 212 turns on the printer 76 and causes the program memory 112 to transfer preselected data to the printer to be printed.

If the manual mode was not selected, another mode determining means or step 220 determines if another preselected mode has been selected. If so, a mode implementing means or step 222 implements the other selected mode. Other modes may include a weekend or heavy traffic mode, a chlorination mode, a pool filling mode, or the like.

The invention has been described with reference to the preferred embodiment. Obviously, modifications and alterations will occur to others upon reading and understanding the preceding detailed description of the preferred embodiments. It is intended that the invention be construed as including all such alterations and modifications in so far as they come within the scope of the appended claims or the equivalents thereof.

Having thus described a preferred embodiment, the invention is now claimed to be:

1. A method of controlling the circulation of a fluid through a filter, the method comprising cyclically repeating the steps of:

selecting a filter flow path which directs a flow of fluid through the filter in a forward filtering flow direction;

pumping the fluid under pressure;

sensing the pressure of fluid adjacent the filter; and, with a microprocessor:

selectively monitoring the sensed fluid pressure;

comparing the sensed fluid pressure with a preselected high limit;

in response to the sensed pressure exceeding the high limit, stopping the pumping of the fluid;

after stopping the pumping, selecting a backwash flow path which directs the flow of fluid through the filter in a reverse, backwashing flow direction;

after selecting the backwash flow path, recommencing pumping the fluid to backwash the filter, and discharging at least a portion of the fluid through a drain line;

after a backwash duration, stopping the pumping of the fluid and selecting a flow path which again directs the fluid through the filter in the filter direction;

determining a volume of fluid discharged through the drain line; and, replacing the discharged fluid with a like volume of fresh fluid.

2. A method of controlling the circulation of a fluid through a filter, the method comprising cyclically repeating the steps of:

selecting a filter flow path which directs a flow of fluid through the filter in a forward filtering flow direction;

pumping the fluid under pressure;

sensing the pressure of fluid adjacent the filter; and, with a microprocessor;

selectively monitoring the sensed fluid pressure;

determining whether the sensed fluid pressure exceeds a preselected low limit;

in response to the sensed pressure failing to exceed the low limit within a selected duration of commencement of pumping, causing termination of the fluid pumping step, whereby pumping is terminated in response to a low pressure limit to protect pumping equipment from damage;

comparing the sensed fluid pressure with a preselected high limit;

in response to the sensed pressure exceeding the high limit, causing selection of a backwash flow path which directs the flow of fluid through the filter in a reverse, backwashing flow direction;

after selection of the backwash flow path, causing the fluid to be pumped back to the filter; and, after a backwash duration, causing termination of the pumping of the fluid.

3. An apparatus for controlling the circulation of water through a water filter to selectively filter the water and backwash the filter, the apparatus comprising:

a flow direction control means for selectively controlling the circulation of the water through the filter to circulate the water therethrough selectively in one of a first or filtering direction and a second or backwash direction;

a fluid pumping means for selectively pumping the water through the flow direction control means to the filter;

a pressure sensing means for sensing water pressure adjacent the filter; and, a microprocessor operatively connected with the pumping means, the flow direction control means, and the pressure sensing means, the microprocessor including:

a pump control means for selectively causing the pumping means to pump the water, a flow direction selection means for selectively causing the flow direction control means to direct the water through the filter in one of the filtering and backwash directions, a filter timing means for selectively causing the pump control means to actuate the pumping means at selected intervals for selective durations while the flow direction control means is directing water through the filter in the filtering direction, a first timing means for timing a first duration from actuation of the pumping means, a pressure sensor monitoring means for monitoring the pressure sensing means and providing an electrical signal indicative of the sensed water pressure;

a low pressure determining means for comparing the electrical signal from the pressure sensor monitoring means with a preselected low limit, the low pressure determining means being operatively connected with the first timing means and the pump control means for selectively blocking operation of the pumping means in response to the sensed pressure failing to exceed the low limit within the first duration, a high pressure determining means for comparing the electrical signal from the pressure sensor monitoring means with a preselected high limit, the high pressure determining means being operatively connected with the flow direction selection means to direct the fluid through the filter in the backwash direction, and a backwash timing means for actuating the pump control means for a preselected backwash duration such that water is pumped through the filter in the backwash direction for the preselected backwash duration.

4. An apparatus for controlling the circulation of water through a filter, the apparatus comprising:

a flow direction control means for selectively controlling the direction in which the water is circulated through the filter between a filtering direction and a backwash direction;

a pumping means for selectively pumping water to the flow direction control means under pressure;

a pressure sensing means for sensing the water pressure adjacent the filter;

a drain line operatively connected with the flow direction control means for discharging at least a portion of the water pumped through the filter in the backwash direction, a replacement water supply means for selectively supplying fresh water; and, a microprocessor operatively connected with the flow direction control means, the fluid pumping means, the pressure sensing means, and the replacement water supply means, the microprocessor including:

a pump control means for selectively actuating the pumping means to pump water;

a filter cycle timing means for selectively enabling the pump control means to actuate the pumping means at selected intervals for selected filter durations;

a high pressure determining means operatively connected with the pressure sensing means for determining whether the sensed water pressure exceeds a preselected high limit;

a flow direction selecting means for selectively causing the flow direction control means to change the direction of water flow through the filter between the filtering direction and the backwash direction in response to the sensed pressure exceeding the high limit;

a backwash timing means for actuating the pumping means to supply water under pressure through the filter in the backwash direction for a backwash duration, at least a portion of the water being discharged through the drain line, and for causing the flow selection means to change the direction of flow through the filter at the end of the selected backwash duration to the filtering direction such that the water is again pumped through the filter in the filter direction; and, a water replacement means for determining a volume of water discharged through the drain line and for causing the replacement water supply to supply a like volume of fresh water.

5. The apparatus as set forth in claim 4 wherein the water replacement means calculates the volume of discharged water from the water pressure sensed by the pressure sensing means and from the backwash duration.

6. The apparatus as set forth in claim 4 wherein the microprocessor further includes a memory for selectively storing operating instructions and for selectively storing data concerning system malfunctions, which memory loses stored data during a power loss; and, a battery backup for automatically supplying electrical power to the microprocessor in the event of a disruption of power supplied by an external power source, such that data stored in the memory of the microprocessor is maintained during the power failure.

* * * * *